US011611828B2

(12) United States Patent
Smyth

(10) Patent No.: US 11,611,828 B2
(45) Date of Patent: Mar. 21, 2023

(54) SYSTEMS AND METHODS FOR IMPROVING AUDIO VIRTUALIZATION

(71) Applicant: Stephen Malcolm Frederick Smyth, Downpatrick Down (GB)

(72) Inventor: Stephen Malcolm Frederick Smyth, Downpatrick Down (GB)

(73) Assignee: Stephen Malcolm Frederick Smyth, Downpatrick Down (GB)

( * ) Notice: Subject to any disclaimer, the term of this patent is extended or adjusted under 35 U.S.C. 154(b) by 1066 days.

(21) Appl. No.: 16/303,933

(22) PCT Filed: May 24, 2017

(86) PCT No.: PCT/EP2017/062697
§ 371 (c)(1),
(2) Date: Nov. 21, 2018

(87) PCT Pub. No.: WO2017/203011
PCT Pub. Date: Nov. 30, 2017

(65) Prior Publication Data

US 2020/0322727 A1 Oct. 8, 2020

(30) Foreign Application Priority Data

May 24, 2016 (GB) ..... 1609089

(51) Int. Cl.
*H04R 5/04* (2006.01)
*H04R 3/12* (2006.01)
(Continued)

(52) U.S. Cl.
CPC ..... *H04R 5/04* (2013.01); *H04R 3/12* (2013.01); *H04R 5/033* (2013.01); *H04R 29/001* (2013.01); *H04S 7/304* (2013.01); *H04S 2420/01* (2013.01)

(58) Field of Classification Search
CPC . H04R 5/04; H04R 3/12; H04R 5/033; H04R 29/001; H04S 7/304; H04S 2420/01
See application file for complete search history.

(56) References Cited

U.S. PATENT DOCUMENTS

2006/0056638 A1 3/2006 Schobben
2013/0272527 A1 10/2013 Oomen et al.
2018/0091920 A1* 3/2018 Family ..... H04S 1/005

FOREIGN PATENT DOCUMENTS

WO 2006024850 A2 3/2006
WO 2015058818 A1 4/2015

OTHER PUBLICATIONS

International Search Report and Written Opinion dated Sep. 18, 2017, for corresponding International Application No. PCT/EP2017/062697; International Filing Date: May 24, 2017, consisting of 14-pages.

* cited by examiner

*Primary Examiner* — Andrew L Sniezek
(74) *Attorney, Agent, or Firm* — Christopher & Weisberg, P.A.

(57) ABSTRACT

Virtual sound room rendering is most realistic when the listener has themselves been the subject of the binaural room impulse response measurements, and most pleasing when the sound room involved has a high acoustic fidelity. Where the listener has no access to good sound rooms non-personalised high fidelity sound rooms are modified using information from a listener's personalised binaural impulse response data to improve the realism of such rooms. Where sound rooms are available, information from higher fidelity non-personalised sound rooms are used to improve the sound quality of the listener's personalised room data. Alternatively either personalised or non-personalised rooms
(Continued)

can be improved through modification of their reverberation characteristics according to the listener's taste.

28 Claims, 10 Drawing Sheets

(51) Int. Cl.

| | |
|---|---|
| ***H04R 5/033*** | (2006.01) |
| ***H04R 29/00*** | (2006.01) |
| ***H04S 7/00*** | (2006.01) |

$$\text{sample}(n)=\text{sample}(n)*\text{GAIN}*e^{n/\text{ENV}}$$

.....where 3000<ENV or ENV<-1200

SYSTEMS AND METHODS FOR IMPROVING AUDIO VIRTUALIZATION

CROSS-REFERENCE TO RELATED APPLICATIONS

This application is a Submission under 35 U.S.C. § 371 for U.S. National Stage Patent Application of International Application Number PCT/EP2017/062697, filed May 24, 2017, entitled SYSTEMS AND METHODS FOR IMPROVING AUDIO VIRTUALIZATION, which claims priority to Great Britain Application No. 1609089.6, filed May 24, 2016, the entirety of both of which is incorporated herein by reference.

FIELD OF THE INVENTION

This invention relates generally to the field of three-dimensional audio reproduction, or audio virtualisation, over headphones or earphones.

BACKGROUND TO THE INVENTION

The capture of binaural room impulse responses and their subsequent use for creating virtualised sound is well known, see for example International patent application WO 2006024850. In summary, binaural room impulse responses comprise impulse response data of sound sources in a room, such as loudspeakers, placed at specific orientations with respect to the head, whose transfer functions are measured at the head by placing microphones in, or around, the left and right ear canals. A common use of binaural impulse responses is for the virtualisation of loudspeakers over headphones. Virtualisation is implemented by convolving, or rendering, audio signals with the binaural impulse responses which are then presented to the listener over headphones. In such applications the intention is often to faithfully reproduce the sound of the real loudspeakers in terms of spatiality, timbre and room reverberation.

Unfortunately the degree of realism, that is, how similar the virtualised loudspeakers heard over the headphones are compared to the real loudspeakers, is dependent on whether the listener is using impulse data measured at their own ears or at the ears of a different head. When using impulse data measured at their own ears the virtual and real sound can appear to be almost identical making for a very effective out-of-head experience. On the other hand, listening to virtualised sound rendered using impulse data measured elsewhere, the degree of realism will often be considerably less.

Although personalised impulse measurements (PRIRs) are very effective, high fidelity measurements can be difficult to obtain unless the listener has access to professional sound rooms with good acoustic properties, high quality sound reproduction equipment, and an appropriate loudspeaker layout. Making measurements in the home, while straightforward enough, will ordinarily only achieve the same acoustic properties of the room they are made in. Improving the fidelity of a room often necessitates structural alterations and prodigious acoustic treatment of the room surfaces, all of which is normally beyond the reach of the average listener.

It would be desirable therefore to improve virtual sound rooms, or audio virtualisation, rendered over headphones or ear phones.

SUMMARY OF THE INVENTION

A first aspect of the invention provides a method for creating binaural room impulse response data as claimed in claim 1.

A second aspect of the invention provides a method for modifying data representing a binaural room impulse response as claimed in claim 29.

A third aspect of the invention provides a digital signal processing apparatus for creating binaural room impulse response data as claimed in claim 37.

A fourth aspect of the invention provides a digital signal processing apparatus for modifying data representing a binaural room impulse response as claimed in claim 39.

A fifth aspect of the invention provides an audio virtualisation method as claimed in claim 40.

A sixth aspect of the invention provides an audio virtualisation system as claimed in claim 41.

Preferred embodiments of the invention involve modification of binaural room impulse responses, whether they be recorded using a head of a dummy or that of a human subject, for the purpose of improving the realism and sound quality of the virtualised room. Aspects of the invention provide a method and apparatus that allow for the subjective improvement of virtual sound rooms rendered over headphones or ear phones through manipulation of the BRIR or PRIR data.

A binaural room impulse response comprises a respective impulse response for each ear, left and right, of a listener. When recording an impulse response the target listener may be a real person (in which case the resulting response data may be said to be personalised to that person) or may be a dummy or a person other than the target listener (in which case the resulting response data may be said to be non-personalised). Each impulse response is characterised by a transfer function. The transfer function determines, or characterises, how an input signal is transformed to produce an output signal. In the context of a room impulse function, the transfer function comprises a Head Related Transfer Function (HRTF) that characterises how an ear receives a sound from a point in space. Each impulse response comprises a Head Related Impulse Response (HRIR) portion, an early reflections portion and a reverberation portion. In the time domain, the HRIR is the first of these portions, i.e. it comprises the portion of the impulse response over an initial time period. This initial time period corresponds to the period before any reflected sounds arrive at the ear. As such, the HRIR may be regarded as a non-room related portion of the impulse response.

The early reflections portion appears after the HRIR portion, i.e. it comprises a portion of the impulse response over a second time period after said initial time period. The second time period corresponds to a period when reflections arrive at the ear from surfaces in the room such as objects, walls, the floor and ceiling. These reflections may be deemed to be early reflections in that they may primarily comprise signals that have been reflected once before arriving at the ear. The reverberation portion (which may also be referred to as the late reflections portion) appears after the early reflections portion, i.e. it comprises a portion of the impulse response over a third time period after said second time period. The third time period corresponds to a period when further reflections arrive at the ear from surfaces in the room such as objects, walls, the floor and ceiling. These reflections may be deemed to be late reflections in that they may primarily comprise signals that have been reflected more than once before arriving at the ear. The early reflections portion and the reverberation portion may be regarded as room-related portions of the impulse response.

From each, or at least one, pair of impulse responses (i.e. one for each of the left and right ears) an Inter-aural Delay (ITD), can be determined. The ITD, which may also be referred to as the Inter-aural Difference, is an indication of the acoustic path difference between the two ears.

Typically, a binaural room impulse response data set comprises data representing a plurality of binaural room impulse responses, each one associated with a different loudspeaker-to-head orientation. Typically, data indicating the ITD is included in the binaural room impulse response data set.

The binaural room impulse data set is used in a digital signal processing apparatus, for example of a type known as an audio virtualiser, to transform an input audio signal received from a loudspeaker into a virtualised audio signal. The virtualised audio signal is rendered to the listener by headphones. An audio virtualiser may therefore be incorporated between the input interface and the output interface of headphones. The binaural room impulse data set may be referred to as a digital filter, For the purposes of this invention PRIRs are defined as binaural room impulse responses measured at the ears of the same person (i.e. a target (human) listener) that listens to the virtualised headphone or ear phone sound rendered by such impulse data, i.e. personalised. Whereas BRIRs are defined as generic binaural room impulse responses that were not measured at the ears of the target listener, i.e. non-personalised. The person that desires to use this invention for the purpose of improving what they hear over their headphones, or earphones, is herein referred to as the listener. The term "headphones" as used herein is intended to embrace "ear phones".

According to one aspect of the invention there is provided a method and apparatus for taking a BRIR data set and improving the perceived quality of that virtual sound room by incorporating certain information from the listener's PRIR data set into the said BRIR data set. Such a method is significant since it is relatively easy for a listener to measure their own PRIRs in their own home and then, for example, obtain a high quality sound room BRIR from anywhere in the world via internet download. This, and similar, aspects of the invention may be said to involve replacing one or more non-room related portions of a binaural room impulse response data set with corresponding non-room related portion(s) of another binaural room impulse response data set, in particular where the former is non-personalised and the latter is personalised.

According to another aspect of the invention there is provided a method and apparatus for taking a listener's PRIR data set and improving the perceived quality of said PRIR virtual sound room by making its reverberation characteristic and/or its early reflection characteristic conform to that of a BRIR data set. This method is particularity effective where both the PRIR and BRIR data sets represent similar sizes of room and speaker layout and where the difference in reverberation properties between them is moderate. An example application of this method is when the listener wishes to improve the sound quality of their home theatre PRIR data set by using a higher quality BRIR data set as a reference. This, and similar, aspects of the invention may be said to involve replacing one or more room related portions of a binaural room impulse response data set with corresponding room related portion(s) of another binaural room impulse response data set, in particular where the latter data set was created in a room with better acoustic characteristics than the former data set (and where typically the former data set is personalised and the latter is non-personalised).

According to another aspect of the invention there is provided a method and apparatus for allowing the listener to manually adjust the reverberation properties of a PRIR, BRIR, hybrid PRIR or hybrid BRIR data set, both in time and frequency, as a means of improving the perceived quality of the virtual sound room contained within.

From another aspect the invention provides a method of improving the perceived spatial and/or timbre naturalness of a non-personalised binaural room impulse response (BRIR) by altering certain features of the said BRIR impulse data to more closely match those found in a listener's own personalised binaural room impulse data set (PRIR).

Advantageously the head related portion (HRIR) of the said BRIR is replaced with the listener's own personalised HRIR data. In preferred embodiments, one or more specific frequency components, or a range of frequency components, of the HRIR data are replaced. It is preferred that the inter-aural timings of the said BRIR data set are altered to more closely match those extracted from the listener's own head related impulse response. Preferably an omni-directional head related transfer function (HRTF) of the said BRIR data set is used in combination with the omni-directional head related transfer function (HRTF) of the listener themselves to alter the reflection and/or reverberation portion of the said BRIR data set. Preferably the reflection and/or reverberation portion of the said BRIR data is altered using a filter that represents the difference between the omni-direction HRTFs of the said BRIR and listener, the difference being determined either by direct analysis of the two transfer functions or empirically using an AB listening test between the two.

A further aspect of the invention provides a method of improving the perceived sound quality of any personalised or non-personalised binaural room impulse response (PRIR or BRIR) by altering the frequency response and time decay characteristics of the reflection and/or reverberation portions of the said PRIR or BRIR data set.

In preferred embodiments the frequency response and time decay is altered to conform to the said characteristics of a reference PRIR or BRIR data set. Preferably said characteristics are made to conform either by direct analysis of data set to be altered and the reference data set, or empirically using an AB listening test between the two.

Preferred features of the invention are recited in the dependent claims appended hereto.

Further advantageous aspects of the invention will be apparent to those ordinarily skilled in the art upon review of the following description of specific embodiments and with reference to the accompanying drawings.

BRIEF DESCRIPTION OF THE DRAWINGS

Embodiments of the invention are now described by way of example and with reference to the drawings in which.

DETAILED DESCRIPTION OF THE DRAWINGS

Figure 1:
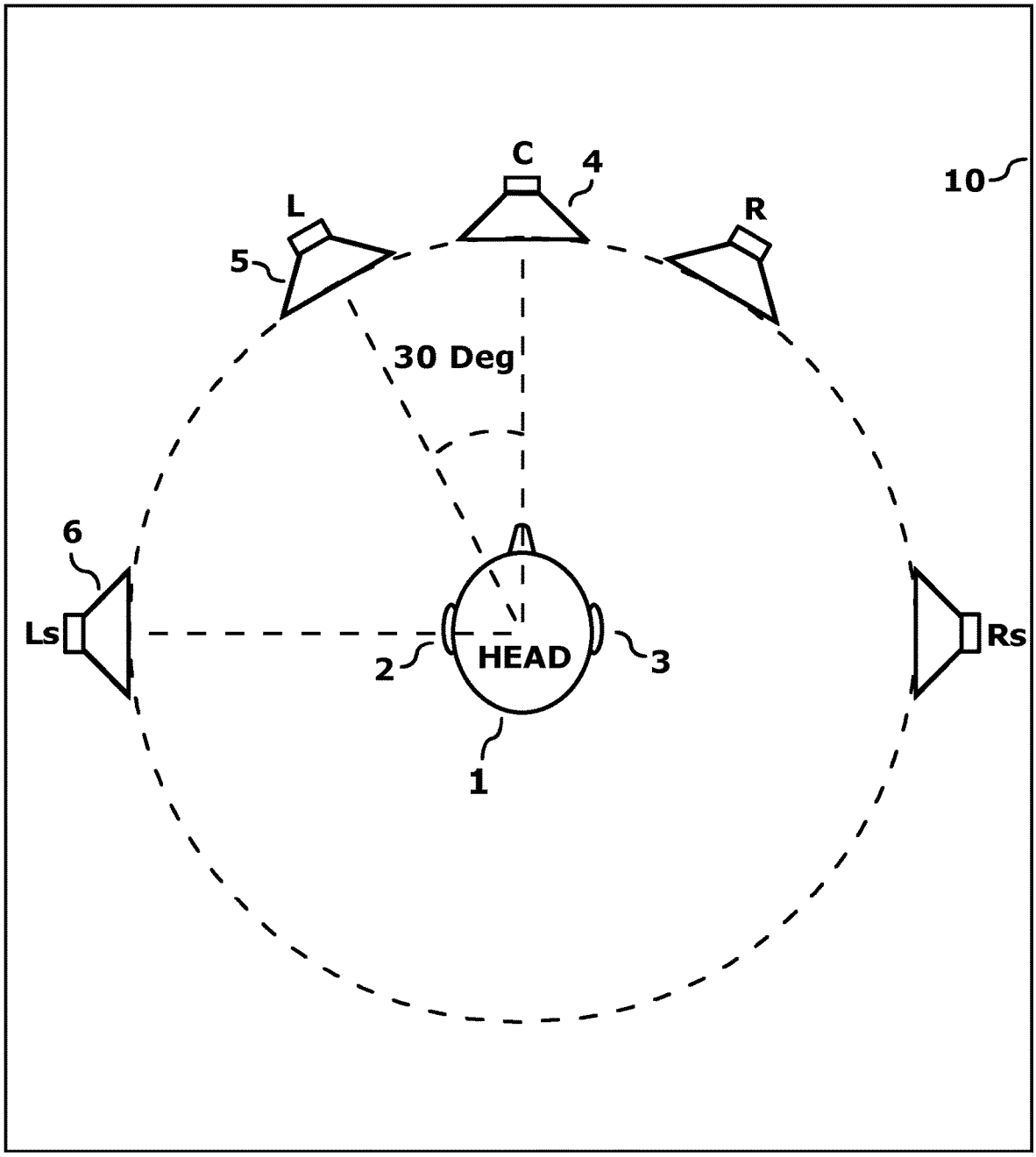
FIG. 1 is a plan view illustration of a head surrounded by five loudspeakers.

Binaural room impulse responses typically represent virtual loudspeakers in a virtual sound room as perceived by a human subject. FIG. 1 illustrates a plan view of an example virtual sound room 10 containing five virtual loudspeakers (L,C,R, Ls and Rs) positioned on a circle with a human subject in the centre and where their elevations are all at ear level. For the purposes of clarity the illustration of the human subject shows only the head 1 together with the left ear 2 and right ear 3 with the head pointing towards the centre loudspeaker 4. If this virtual sound room were to be rendered over headphones the centre speaker 4 would be heard directly ahead of the listener, the left loudspeaker 5 thirty degrees to the left of centre and the left surround speaker 6 would be heard ninety degrees to the left of centre and so on. It will be understood that the configuration of FIG. 1 is not limiting to the invention. In general, there is one or more speaker each positioned with respect to the head position at any respective location (typically defined by azimuth angle and elevation with respect to the head position).

Figure 2:
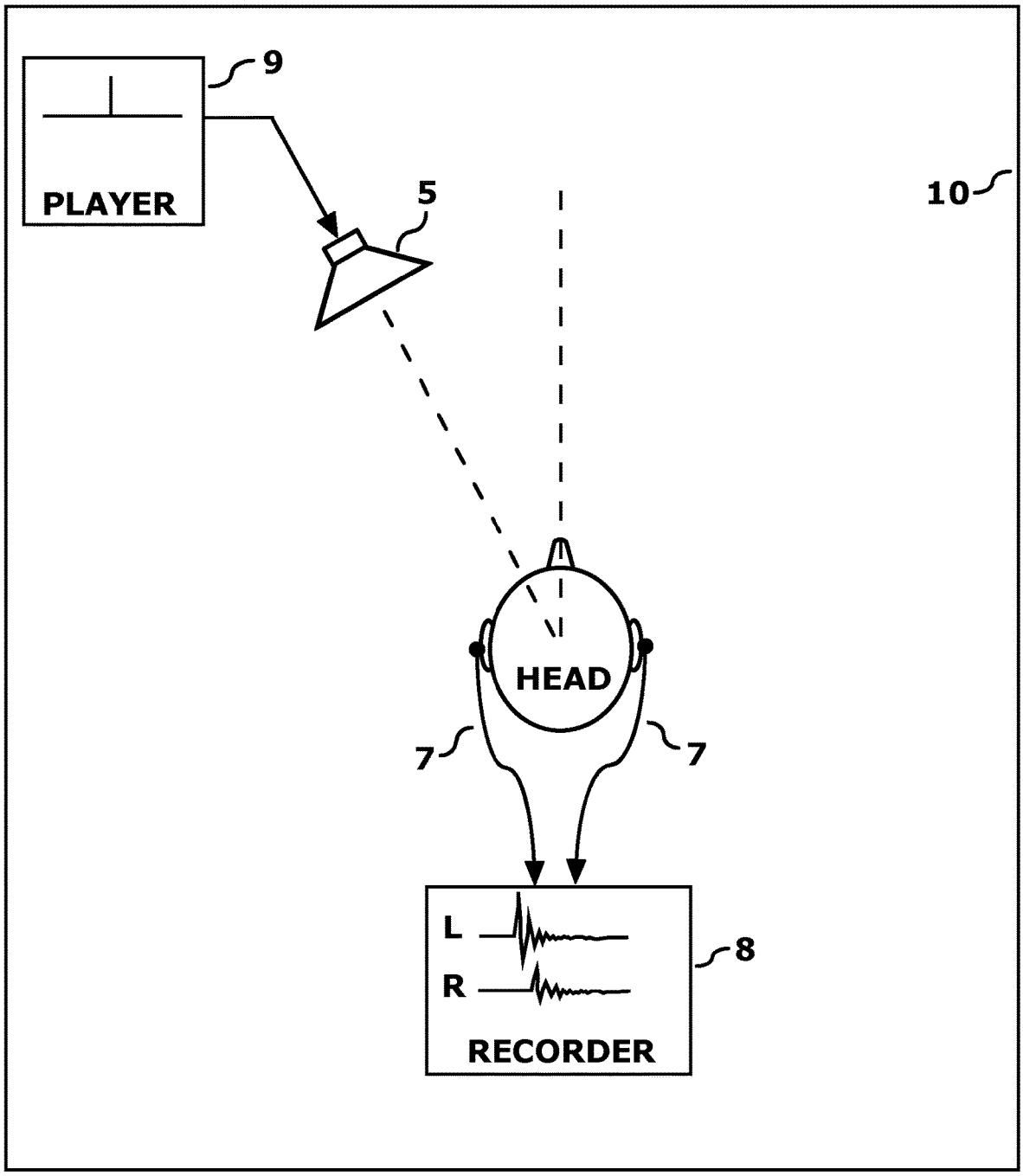
FIG. 2 is a plan view illustration of a head undertaking a binaural room impulse measurement of a single loudspeaker in a room.

FIG. 2 illustrates one process by which binaural room impulse responses may be measured. In this example the left loudspeaker 5 is to be measured in room 10. The appropriate head (human or dummy) to loudspeaker orientation is setup such that the desired loudspeaker angle and distance is achieved. In this example the loudspeaker 5 is thirty degrees to the left of centre. Next a single impulse signal 9 is played out the loudspeaker 5 and the binaural room impulse response recorded 8 using microphones 7 located in each ear. This binaural room impulse response comprises data representing an impulse for each ear and contained within the impulse data is, among other things, information about the acoustic path distance between the two ears, known as the Inter-aural Time Delay (ITD), the shape of the subjects outer ears (or pinna), head and shoulders, known as the head related transfer function (HRTF) and all of the different paths the impulse travels on around the room before arriving at the microphones.

A binaural room impulse response (whether personalised or non-personalised) is typically created for any one or more of: the or each loudspeaker; and the, or each, orientation of the head position with respect to the or each loudspeaker. This results in a respective binaural room impulse response for each of a plurality of loudspeaker-to-head orientations. Collectively, these responses, or more particularly data representing these responses, can be referred to as a binaural room impulse response data set, e.g. a BRIR data set or a PRIR data set.

Figure 3:
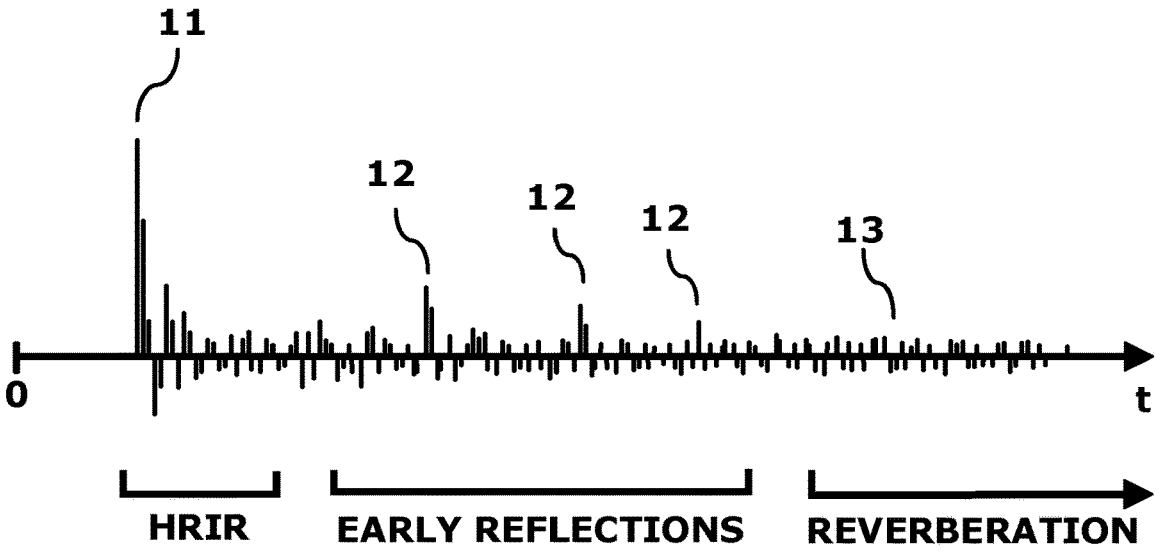
FIG. 3 is a simple illustration of a binaural room impulse response plotted in the time domain showing head related impulse response (HRIR), early reflections and reverberation portions.

FIG. 3 is a simple illustration of a typical time domain binaural room impulse response for one of the ear recordings. Beginning t=0, prior to the loudspeaker impulse first arriving at the ears the microphone records silence. Then when the impulse arrives using the most direct path the onset 11 is recorded. For the next three to ten milliseconds the microphone records the interaction of this direct impulse with the subjects ear, head and shoulders (in the time domain this is known as the head related impulse response or HRIR) but before any reflections arrive from the room surfaces or objects within the room. Next the early reflections 12 emanating from, for example, the walls, floor and ceiling of the room are recorded, followed by a large collection of late reflections 13, also known as the room reverberation. In practice, impulses 9 are rarely used directly to measure impulse responses in this way since the impulse response signal-to-noise ratio is usually too low. Most measurements involve high energy signals such as sweeps or noise and the recorded signals deconvolved to create the impulse response. Nonetheless, the resulting impulse properties outlined in FIG. 3 are the same for all methods.

In this description no attempt is made to rigidly demarcate these HRIR, early reflections or reverberation samples in a binaural room impulse response in terms of time as these will depend on the dimensions and surface characteristics of the room and the position of the subject in that room. However a binaural room impulse measured in a living room by an adult subject would typically comprise a HRIR portion spanning a first period, e.g. the first five milliseconds (ms), beginning from the onset 11 (FIG. 3), followed by a second period comprising the early reflections 12, which for example may span a further fifty ms, and then a third period comprising the reverberation 13, which may for example comprise a further period of say two hundred ms, giving a total impulse response which in this example spans two hundred and fifty five ms. For a sampling frequency of 48 kHz this would translate to: HRIR the first 240 samples; early reflections the next 2400 samples; reverberation the next 9600 samples. On the other hand a binaural room impulse measured in a small cinema might span 400 ms, or one made in a cathedral, 4000 ms, so clearly the boundaries used in the embodiment need to be flexible to accommodate a range of measurement conditions.

Figure 4:
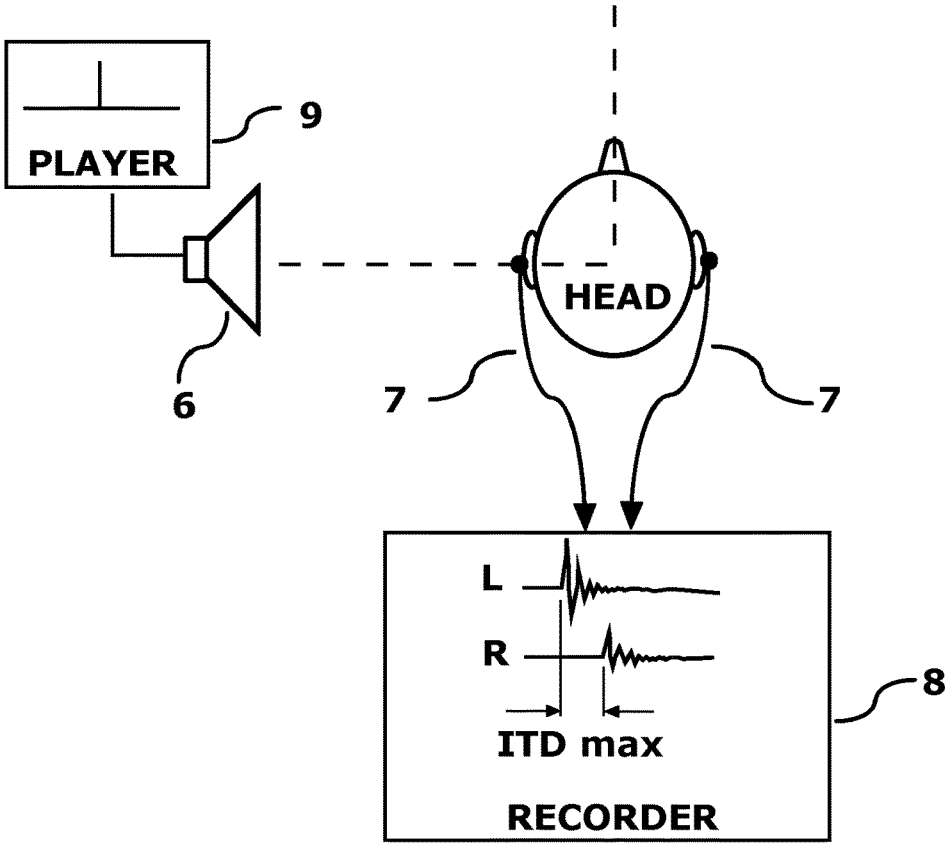
FIG. 4 is a plan view illustration of a head undertaking a binaural room impulse measurement with maximum inter-aural time delay (ITD)

FIG. 4 illustrates a similar setup to FIG. 2 except that the loudspeaker 6 under measurement is perpendicular to the subject's head, i.e. at ninety degrees left of centre, and elevated to ear level. This speaker position is one that results in the greatest acoustical path difference, or ITD, between the left and right ear impulse responses, seen as a time delay between the impulse onsets of the recorded impulse response 8. Likewise a loudspeaker ninety degrees right of centre will exhibit the same maximum delay.

Virtual sound room rendering is most realistic when the listener has themselves been the subject of the binaural room impulse response measurement. In other words the listener must go to a room to be measured for best performance. Unfortunately the acoustical properties of sound rooms have a significant effect on the perceived quality of the reproduced sound. Music and film studios, professional listening rooms and auditoriums are designed with this in mind and will often sound considerably more pleasing than the average living room or home theatre. It makes sense therefore for listeners to seek out the best sound rooms to make PRIR measurements. The difficulty with this approach is that good sound rooms are few and far between and may not be accessible by the general public. A challenge therefore is to create a means by which a listener can take a BRIR measurement, made in an arbitrary sound room by an arbitrary person, and improve the virtual realism of such a non-personalised sound room when listening over their own headphones. In this way a BRIR of a good sound room could be downloaded over the internet, for example, processed to improve the rendering for the specific listener, and used as an alternative to a PRIR made in such sound room. It would not be expected that the processed BRIR would ever sound superior to a PRIR made by the listener in the same room, but the aim is to make the BRIR more listenable. Human sound localisation and rendition is affected by three main processes. First the time of arrival of a sound at each ear can be used by the brain to determine the direction of a sound, i.e. if it arrives at the left ear first then the sound is coming from the left side. Second, the way the sound interacts with the outer ear (pinna), head and shoulders before entering the ear canal. This modification is used by the brain to help determine direction when there is no time delay between the ears, for example when the sound is coming from directly in front. Third, the ear that is receiving the loudest sound indicates to the brain that the sound source is on the same side as that ear.

For low frequency sounds, both ears hear much the same signal since obstructions such as the head and pinna are small compared to the wavelength of the sound wave and are essentially invisible to such frequencies. It can be deduced therefore that low frequency components of a binaural room impulse response are similar across the general population except only for the time delay between the two ears, this delay being related to the distance between the subject's ears.

As the frequency of sound increases so too does the level of interaction with the head and in particular sounds coming from one side of the head or the other will tend to be attenuated by the time they reach the ear canal on the far side—known as head shadowing. Increasing the frequency of sound still further—as the wavelength drops below the physical size of the subject's outer ear the sound is modified by reflections and resonances set up around this structure prior to entering the ear canal. Such frequencies are also heavily affected by head shadowing.

Another deduction that could therefore be made is that BRIR frequencies below those that begin to interact with the outer ear are mostly affected by head shadowing and that the attenuation properties are probably similar from head to head since head composition and size does not vary much from person to person. Again it would be the variation in distance between subject's ears that has the biggest impact.

Another deduction is that, since the shapes of outer ears are clearly different across the general population, the greatest difference between BRIRs occurs in the frequency band where the sound interacts with the outer ear. In terms of personalisation, this is the region that makes a sound room rendered with a PRIR sound realistic and that with a BRIR sound vague. Worse, listening to another person's PRIR can not only cause vagueness in the virtual loudspeaker positions but can also cause an unnaturalness in the tonality or timbre of the overall sound being heard over the headphones, i.e. they can often sound too bright or too dull.

Modifying a BRIR Using Information from a PRIR

One feature of an embodiment of the invention is the facility to improve the perceived sound quality of a BRIR data set by incorporating certain information from the listener's PRIR data set into the said BRIR data set. The preferred process of incorporating this information involves the following three steps. In alternative embodiments, any one of these steps may be used on its own, or any two may be used in combination with each other.

1. Use PRIR ITD Information

First, the inter-aural time delay (ITD) information in the BRIR loudspeaker data is replaced by that of listener's equivalent PRIR loudspeaker data. An example of such ITD information is disclosed in WO 2006024850. This information preferably comprises right-ear to left-ear delay values, typically measured in fractional sample periods, for each head orientation and for each loudspeaker (or for each loudspeaker-to-head orientation). Replacing this data ensures the listener experiences virtualisation delays matched to their own head size and ear separation.

2. Use PRIR HRIR Information

Second, for each loudspeaker represented in a BRIR the listener should have available a personalised measurement (PRIR) of the same, or similar, loudspeaker position. The room used to make this PRIR is unimportant since only the HRIR portions of the data set are used. Referring to FIG. 3, for each BRIR loudspeaker the impulse response is modified whereby the HRIR section is replaced by either, the HRIR, a band-pass filtered version of the HRIR, or a high-pass filtered version of the HRIR, taken from the corresponding PRIR loudspeaker data. The main benefit of making such a substitution is that the immediate loudspeaker localisation is dramatically improved without affecting the early reflection 12 and reverberation 13 characteristics of the sound room, characteristics that largely define the fidelity of a sound room.

Referring to FIG. 1, say the listener has a BRIR measured in a high quality sound room with a loudspeaker layout as illustrated, containing the impulse data for five loudspeakers, left 5, centre 4, right, right surround and left surround 6 with zero elevation and azimuth angles of thirty degrees left of centre, zero degrees, thirty degrees right of centre, ninety degrees right of centre and ninety degrees left of centre respectively. For any loudspeaker the listener wishes to improve in this BRIR data set they must first have available a PRIR data set which includes loudspeakers measured at the same, or similar, elevation, azimuth and loudspeaker-to-head distance, in order to have available the required personalised data for that loudspeaker position. If this PRIR data does not exist then the listener needs to make the appropriate PRIR measurement(s). FIG. 2 illustrates such a measurement setup from the left 5 loudspeaker. Typically this would be repeated for the other loudspeaker positions to create a complete PRIR data set that matches that of the BRIR. Normally the BRIR loudspeaker-to-head orientations will form part of a BRIR data file (as disclosed by way of example in WO 2006024850), or the information will be available from the owners of the sound room or studio. If no information can be obtained then it would be necessary for the listener to estimate the relative BRIR loudspeaker positions by loading the file into their headphone virtualiser and listening to the individual virtual speakers themselves.

Figure 5:
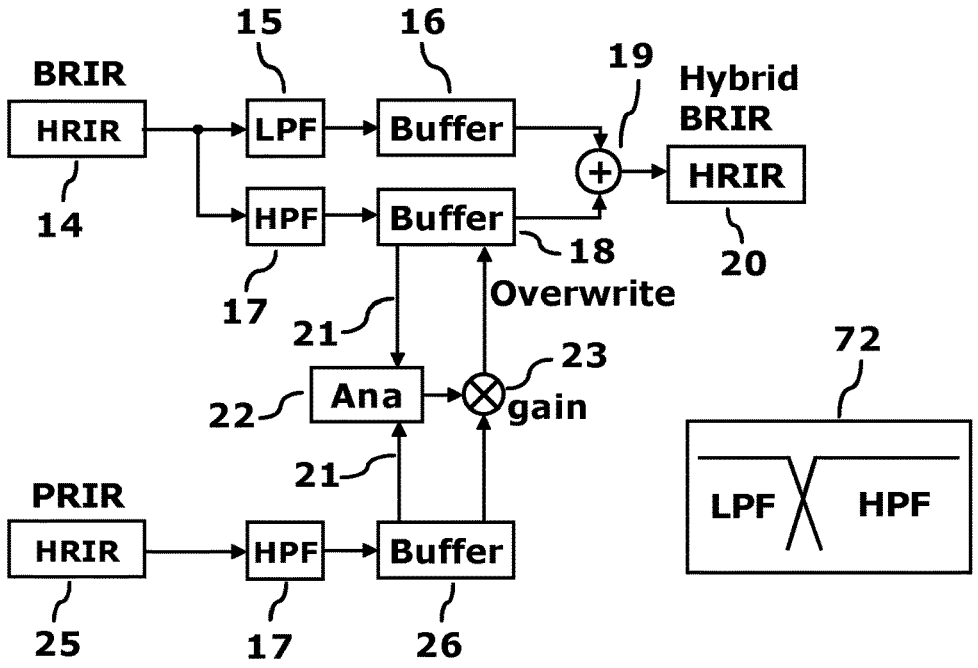
FIG. 5 is a block diagram illustrating a method of, or apparatus for, replacing higher frequency BRIR HRIR information with that from a PRIR.

FIG. 5 illustrates an example of the data processing steps to overwrite the high-pass (HP) filtered BRIR HRIR with a similarly HP filtered PRIR HRIR for just one ear signal of one loudspeaker impulse response. Typically the HRIR region of the binaural impulse responses comprises the onset and three to ten milliseconds beyond, depending on the proximity of the subject to the room surfaces. The extracted BRIR HRIR samples are loaded to a BRIR buffer 14 and the PRIR HRIR samples are loaded to a PRIR buffer 25. The buffered samples 25 are then high pass filtered 17 and stored 26 preferably using either a linear phase FIR filter or an IIR filter with low phase distortion in order to preserve as much as the phase information as possible. The same HP filtering 17 is repeated on the buffered BRIR samples 14 and stored 18. The BRIR samples are also low-pass (LP) filtered 15 using a unity gain overlapping complementary response 72 and stored in buffer 16. If both HP and LP filters have a similar delay then the filtered data is ready to be used otherwise one must realign the LP filtered samples 16 with the HP filtered samples 18 and 26. Next the energies of the HP filtered BRIR 18 and PRIR 26 buffers are calculated 22 and used to create a single gain factor 23. The purpose of the gain stage is to ensure the perceived volume of the PRIR HRIR is similar to the BRIR HRIR it is replacing. Next the HP filtered PRIR HRIR samples 26 are all multiplied by the gain factor 23 and written to the BRIR HRIR buffer 18, overwriting the old values. Finally both BRIR buffers 16, 18 are summed to generate a new hybrid BRIR HRIR 20. This new data would then overwrite the old HRIR data in the original BRIR loudspeaker file, taking into account any delays caused by the LP and HP filtering. This same process would then be repeated for the other ear signal for that loudspeaker by repeating the steps of FIG. 5. Likewise this would be repeated for all the other loudspeaker BRIRs one wishes to modify. For clarity the preferred overlapped unity gain complementary LP and HP filter response is illustrated in box 72.

Figure 6:
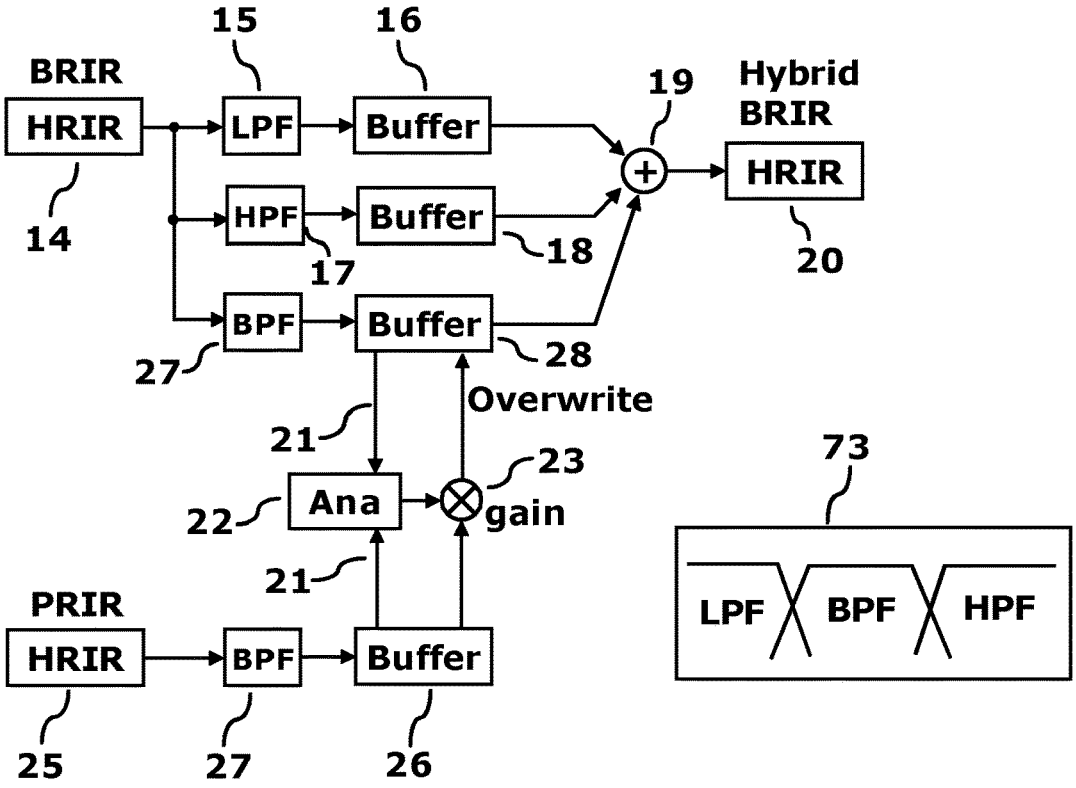
FIG. 6 is a block diagram illustrating a method of, or apparatus for, replacing mid-frequency BRIR HRIR information with that from a PRIR.

FIG. 6 illustrates a similar procedure to FIG. 5 except that only a band-passed (BP) filtered version of the PRIR HRIR 27,26 is used to replace the BP filtered BRIR HRIR samples. In this case both the LP and HP portions of the BRIR HRIR are retained and copied back to the original BRIR. Again for clarity the preferred unity gain overlapping LP-BP-HP filter response is illustrated in box 73.

Although the methods of FIGS. 5 and 6 use only part of the PRIR HRIR spectrum it is perfectly feasible to insert the raw PRIR HRIR directly into the BRIR provided the PRIR measurements are made with a full range loudspeaker. However the other methods have a practical advantage in that they allow the necessary PRIR measurement to be made with much smaller loudspeakers than those used to measure the BRIR. Indeed if the LP cut-off point is set in the region of 1 to 2 kHz the PRIRs could be made with just a lightweight tweeter transducer mounted on, say, a camera tripod. Likewise for the three band method of FIG. 6, if the LP cut-off point is set in the region 1 to 2 kHz and the HP cut-off point set in the region of 10 to 12 kHz the PRIRs could be made, for example, using a smart phone mounted on a hand held wand that could not only output the excitation audio but also record back the binaural microphone signal. Such arrangements would dramatically reduce the inconvenience of making PRIR measurements which are so fundamental to improving the generic BRIRs.

The loudspeaker-to-head orientations of the PRIR loudspeakers being used to replace the BRIR HRIR information preferably have similar orientations as the loudspeakers they are replacing, although a precise match is not necessary. Where the listener uses the method of FIG. 5 or 6 errors in the loudspeaker positions manifest themselves as a shearing of the loudspeaker itself. For example, say a PRIR loudspeaker was measured at thirty degrees to the left of centre and at ear level, while the BRIR loudspeaker being modified was measured at thirty five degrees to the left of centre and at ear level. If the method of FIG. 5 was used with a crossover frequency of 2 kHz then the listener would hear the low frequencies (DC to 2 kHz) appear to come from a source thirty five degrees to the left whereas the high frequencies (above 2 kHz) would appear to come from a source thirty degrees to the left. Clearly then it is best if some effort is made to measure PRIRs whose loudspeaker positions closely match, to within a few degrees, the azimuth and elevation positions of the BRIR loudspeakers, if the listener is to hear all frequencies come from a single point in space. If however the BRIR HRIRs are replaced completely, i.e. no filtering is undertaken, the mismatch would be much less noticeable since the early reflection and reverberant sound has less positional information. Furthermore, in practice, mismatches in the loudspeaker-to-head distances are also much less noticeable. HRIRs measured at two metres will sound very similar to those measured at three metres or even six metres. As such PRIR measurements for this purpose do not ordinarily need to accurately match the BRIR loudspeaker distances.

3. Use PRIR Omni-Directional HRTF Information

Third, while using the PRIR HRIR in this way will significantly improve the ability of the listener to properly localise the BRIR loudspeakers, the early reflections and reverberation still retain the HRTF encoding of the person, or dummy, used to make the BRIR measurement. In particular if their pinna shape is significantly different to the listener's, the listener may perceive an unnatural timbre in the virtualised room reverberation. Fortunately since reflections and reverberation are made up of impulses arriving simultaneously from a wide range of directions it would appear the brain is unable to judge the accuracy of the localisation and hence one person's binaural reverberation will often sound as much out-of-head as another person's reverberation. As such it is possible to reduce colouration through simple equalisation filtering without significantly degrading the BRIRs out-of-head performance.

To implement such an equalisation it is first necessary to estimate the omni-directional HRTF for both the BRIR and PRIR data sets. With these estimations at hand one can either create an equalisation function directly by analysing the difference between the two, or by setting up an A-B listening apparatus that allows the listener to create one through subjective comparison. The early reflection and reverberation samples for all the BRIR virtual loudspeakers can then be filtered with this response to reduce colouration of the virtual sound room. Using the reverberation data of BRIR and PRIRs directly to calculate such omni-directional HRTFs is not desirable since the frequency response of the rooms are also embedded in this data, responses at least for the BRIR, we can assume are unknown. Since the only portion of a binaural room response that has not made contact with any room surface is the HRIR, this data is a better candidate. The down side of using the HRIR is that typically one has only a relatively sparse set of measurements, particularly with a BRIR data set, and therefore estimating a good omni-directional average for the BRIR HRTF will be more challenging.

Fortunately many PRIR/BIRIR data sets (see for example WO 2006024850) include as many as seven different loudspeakers placed around the listener and measured at three look angles (i.e. head positions with respect to the loudspeakers) resulting in as many as twelve different HRIR directions for each ear. This number of directions would likely produce a useful average but more would be better. Indeed it is envisaged that PRIR data set formats would be expanded in the future to include the omni-HRTF data of the subject (human or dummy) that measured the sound room. Thereafter the fixed data set would be automatically inserted into any PRIR file made by the subject for the purposes of helping other listeners automate the colouration reduction step. Although a good average would require the subject to take perhaps twenty to thirty measurements in an even 3D spread around the head, this would not be overly onerous as it would only need to be undertaken once and stored off for future use. In addition, since the main area of interest is the average HRIR colouration caused by the pinna, such measurements can, if desired, involve a small speaker, or tweeter and effectively be made in any type of room without reducing the effectiveness of the data.

Figure 7:
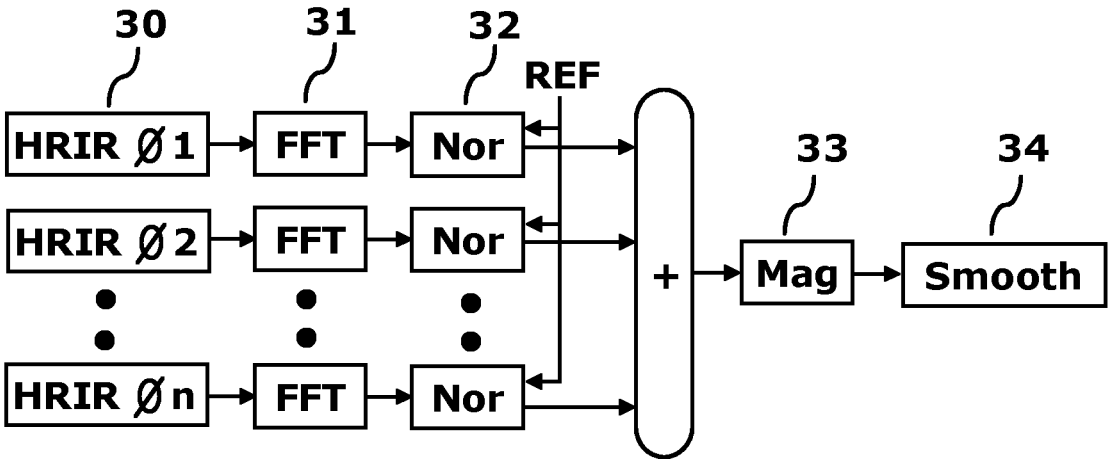
FIG. 7 is a block diagram illustrating a method of, or apparatus for, creating a smoothed averaged HRTF response.
Figure 8:
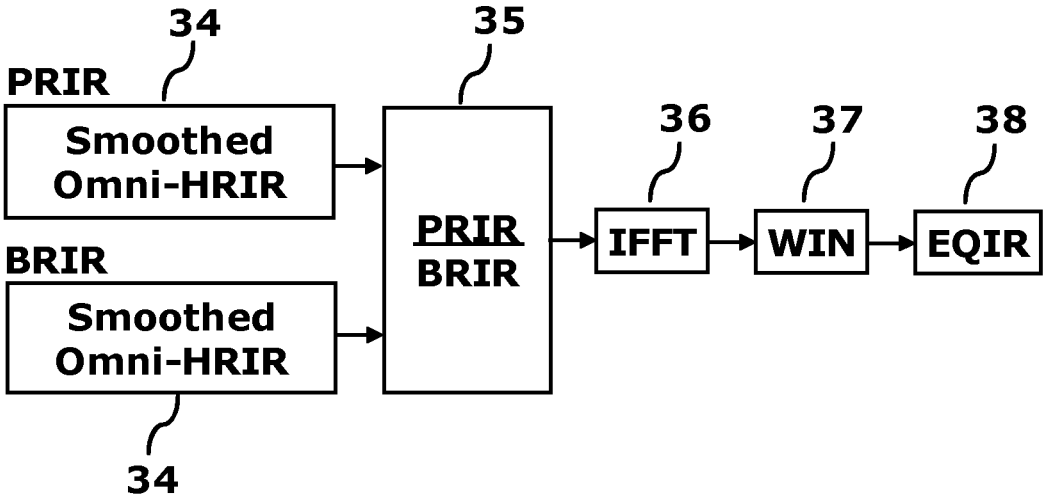
FIG. 8 is a block diagram illustrating a method of, or apparatus for, directly generating equalisation filter coefficients from two smoothed averaged HRTF responses.

FIG. 7 illustrates one method for estimating an average HRTF. HRIRs, for as many different loudspeaker to head orientations as are available, are first loaded to buffers 30. Generally it is preferable to use the same number of loudspeakers with approximately the same orientations for both PRIR and BRIR HRTF average calculations so as to keep them balanced. The contents of the buffers 30 are then converted to the frequency domain 31 using a Fast Fourier Transform (FFT). The complex coefficients sets are then individually scaled 32 such that their DC values, or an average of the low frequency coefficient magnitudes, match across all the sets. The complex coefficient sets are then summed together to form a complex average. The magnitude of the averaged complex coefficients are then calculated 33 and used to replace the real values while the imaginary values are set to zero. A running average smoothing function is then applied across the coefficients 34 in order to help flatten any strong poles or zeros still present in the averaged response. The smoothing function will generally be more aggressive the fewer the loudspeaker positions that make up the average response. This process is repeated for both PRIR and BRIR resulting in two smoothed omni-direction coefficient data sets. FIG. 8 inputs this data 34 and divides each PRIR coefficient with its corresponding BRIR coefficient 35 thereby creating an equalisation curve. The equalisation coefficients are then converted to a linear phase FIR 38 by converting back to the time domain using the inverse FFT 36 and then windowed 37. The resulting FIR coefficients 38 would typically then be normalised in order to produce a unity gain filter. The steps of FIGS. 7 and 8 would be repeated for each ear, resulting in separate left-ear and right-ear equalisation filters. It will be appreciated by those skilled in the art that the method of FIG. 7 is only one way of producing an averaged HRTF and that other methods can equally be deployed without departing from the spirit of this feature of the invention.

Figure 9:
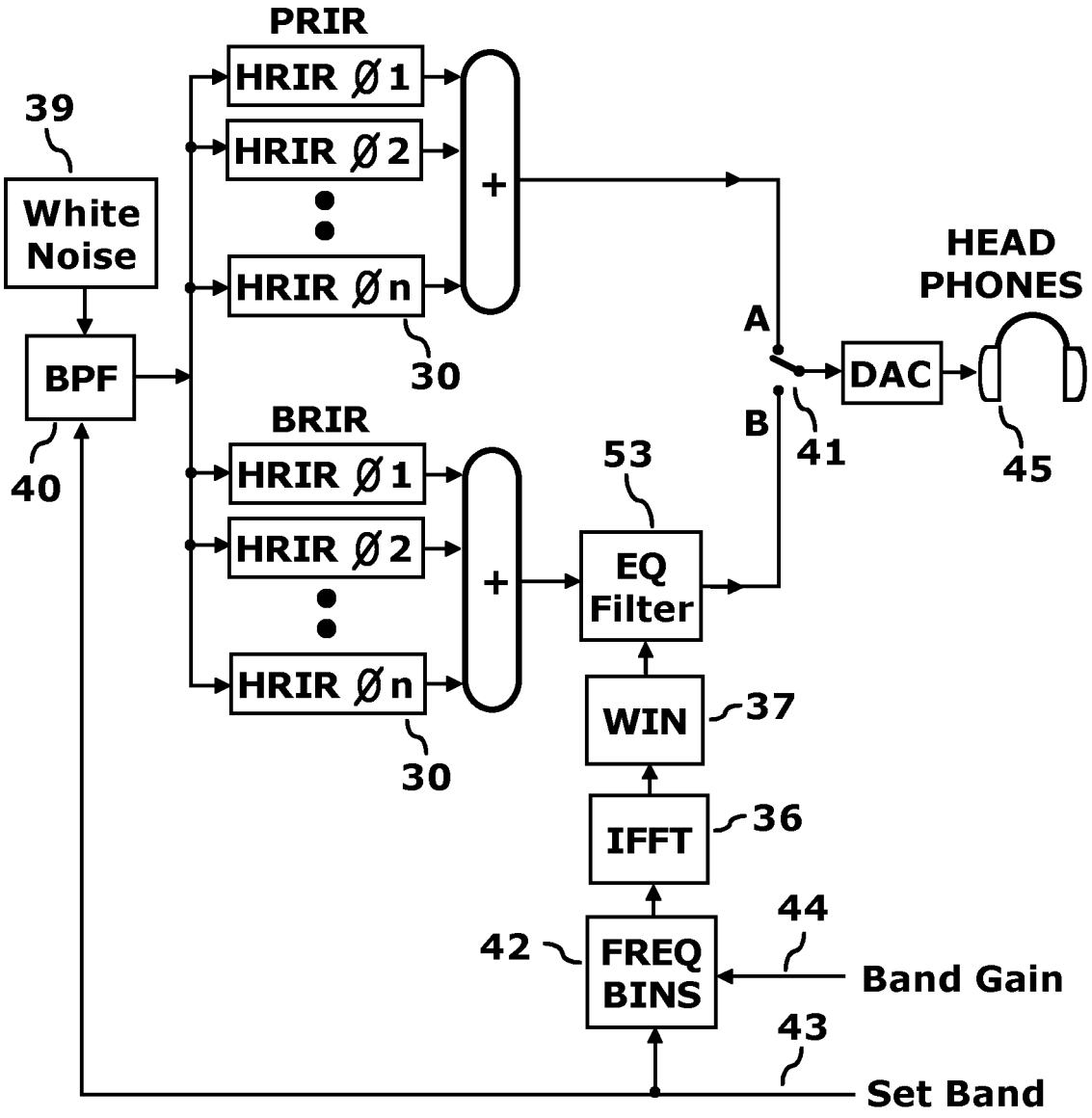
FIG. 9 is a block diagram illustrating a subjective AB comparison method or apparatus for generating equalisation filter coefficients by listening to sound filtered through two groups of HRIRs.

An alternative to the steps described in FIG. 8 is an A-B listening comparison procedure illustrated in FIG. 9. In this method the listener compares the frequency response of their own PRIR omni-HRIR with that of the BRIR omni-HRIR in real-time. This is achieved by listening to white noise 39, or any other signal that covers the frequencies of interest, filtered through a reconfigurable band-pass filter 40 whose output is filtered through both sets of HRIRs 30, and adjusting the equalisation filter 53 such that the volume of the filtered noise heard over the headphones 45 is similar for both switch 41 positions A and B. Typically five to twenty equalisation bands, either uniform or non-uniform, covering the frequency range of interest would be used to achieve a good frequency resolution. The listener would move methodically through each band 40, 43, each time adjusting the band gain 44, until an A-B volume match is heard in the headphones for that band. Each time the user changes the band or adjusts the band gain the equalisation filter must be recalculated. The process of dynamically updating the equalisation filter coefficients follows the steps 36,37 and 38 of FIG. 8 except the amplitude of the binned FFT real coefficients 42 are modified directly using the band gain control 44. The FFT coefficients 42 are grouped into frequency bins that correspond to the sub-band frequency divisions used to band pass 40 the noise signal 39. In this way when the band gain is adjusted by the listener, it is only the magnitude of the FFT coefficients for that band that are altered. Once the listener has finished adjusting the band gains, the final equalisation filter coefficient set 53 can be saved off and used to equalise the BRIR. Again, this listening test would be repeated for each ear for best results.

The method of FIG. 9 could also be implemented by replacing 39 and 40 with a series of pre-filtered noise signal files and selecting one of these to be convolved by the PRIR and BRIR HRIRs 30 under control from set band control 43. Further, the PRIR HRIR sets 30 could also just be summed into one impulse response to convolve the noise signal. Likewise for the BRIR HRIR sets. Furthermore, the PRIR and HRIR sets 30 could be replaced by two smoothed averages 34 that have been converted back to the time domain using steps 36, 37 and 38.

Figure 10:
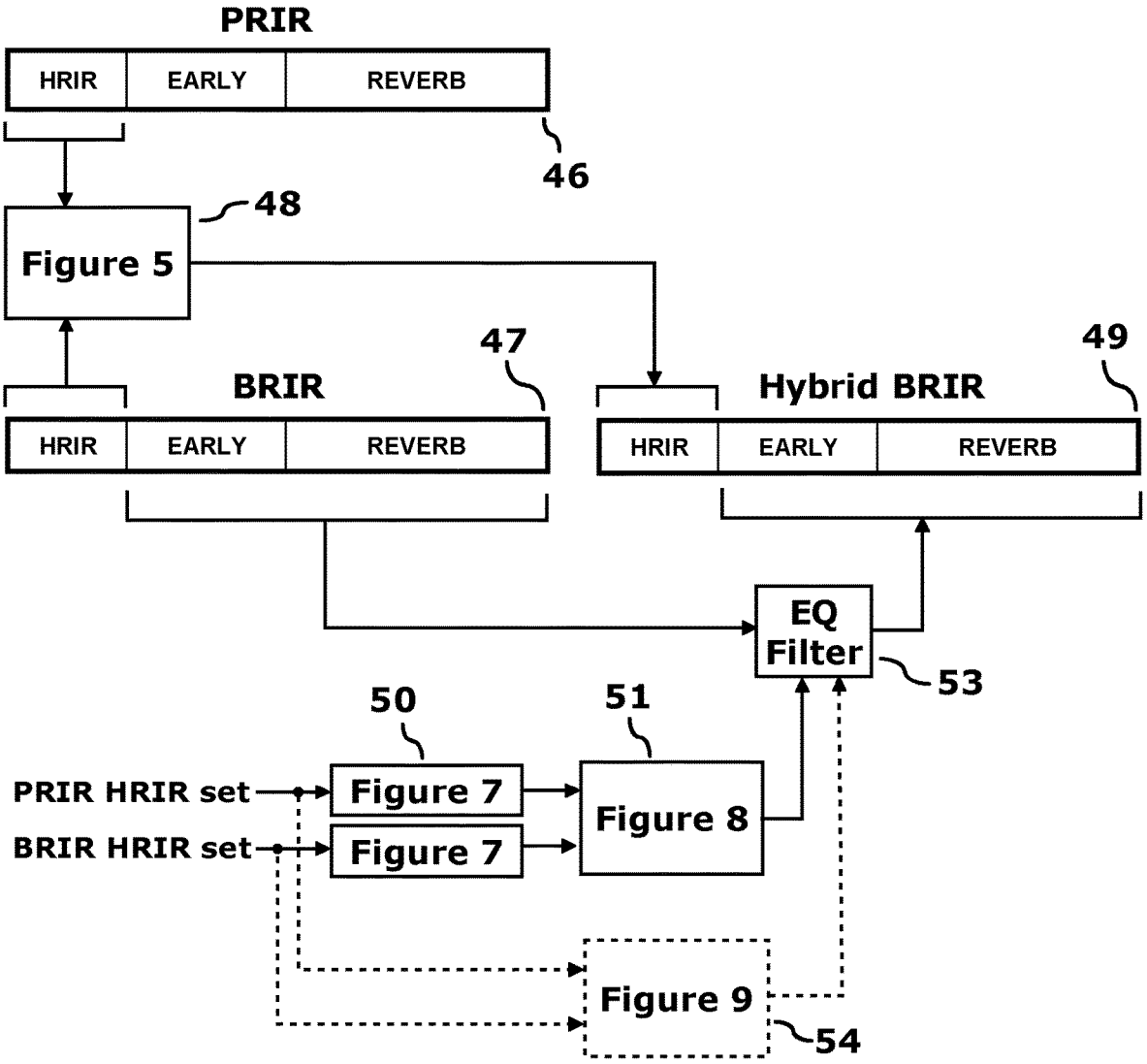
FIG. 10 is a block diagram illustrating steps for generating a hybrid BRIR using information from a PRIR.

FIG. 10 illustrates an overview of the preferred BRIR improvement method where an ear impulse response from a BRIR 47 is modified by a corresponding PRIR ear impulse response 46 and by an equalisation filter 53 to produce a new hybrid BRIR ear impulse 49. For the sake of clarity this illustration does not distinguish between left-ear and right-ear binaural room impulse data so the steps of FIG. 10 need to be applied to each ear separately if separate left/right ear processing is desired.

For example if a listener wants to modify the left-ear BRIR for the front left loudspeaker 5 then they would extract those impulse samples from the BRIR file and place it in the BRIR buffer 47. Likewise they would take the left-ear impulse samples of a PRIR front left loudspeaker and place them in the PRIR buffer 46. A left-ear equalisation filter 53 is loaded with filter coefficients generated by either the direct method FIGS. 7/8 or the subjective method FIG. 9. The BRIR HRIR data set would comprise a number of left-ear loudspeaker measurements corresponding to a range of head orientations and the PRIR HRIR data set would comprise a number of left-ear loudspeaker measurements with similar head orientations. The steps of FIG. 10 are undertaken for each ear of each loudspeaker the listener wishes to modify in the BRIR, except that the same left-ear equalisation filter 53 is used for all left-ear loudspeaker responses and the same right-ear equalisation filter is used for all right-ear loudspeaker responses.

Although FIG. 10 illustrates the use of the equalisation filter for filtering both the early reflection and the reverberation portions of the BRIR, an alternative method is to filter only the reverberation portion and to copy the early reflection portion of the BRIR directly over to the hybrid BRIR. Further, the above description deals with the left and right ear impulses separately. It is also possible to combine the ear impulses to generate a single equalisation filter that is used to filter either ear impulses. This could be a better approach where the availability of loudspeaker HRIR data sets is limited and there is a risk that the averaged HRIRs are too sparse. Likewise the subjective method of FIG. 9 can operate in either mode.

The frequency range of the equalisation (EQ) filter 53 can be from DC to Fs/2 or it can be restricted in scope to focus on a particular region of interest. Since much of the colouration in the BRIR reflection and reverberation samples stems from the pinna of the subject that made the measurement, one mode of operation would be operate the EQ filter, for example, over the range 3 kHz to 20 kHz. However, since colouration can also result from other larger physical features of the subject a hard limit on the minimum frequency is not recommenced. Nonetheless, as discussed earlier, if the listener is making PRIR measurements for the purpose of either using the high-passed HRIR portion to replace that in a BRIR data set or for making a collection of measurements to create an omni-directional HRTF where the low frequencies are not required, then it is possible to do so using a small loudspeaker transducer such as a tweeter or smart phone rather than a full-range loudspeaker.

Finally the hybrid BRIRs 49 are loaded into the listeners virtualiser and used to convolve audio in real-time, thereby recreating the virtual sound room over their headphones.

Modifying a PRIR Using Information from a BRIR

The apparent sound quality of a room is largely dependent on the characteristics of the early reflections and reverberation. A high quality sound room will often have been designed to achieve a particular frequency response and damped reverberation characteristic. The reverberation decay rate will not be fixed across the frequency range and will normally decay faster for higher frequencies. The low frequency reverberation of a room is especially difficult to properly dampen and often requires specialised structural features to control such propagation. Consequently regular living rooms when used as a sound room will often suffer from a lack of reverberation damping, particularly in the lower registers. Hence it would be beneficial for PRIR measurements made in standard, non-treated rooms, to have their reverberation characteristics modified to follow that of a high quality sound room or studio as might be represented in a BRIR data set.

While a number of alternative implementations are described below, preferred embodiments of this aspect take the listener's PRIR data set and improve the perceived quality of that virtual sound room by making its reverberation time and frequency characteristics conform to that of a BRIR data set. Rather than try to improve a non-personalised binaural room response (BRIR) as described previously, if the virtual sound room of a PRIR is of reasonable quality then it may be worthwhile to try and make it sound more like the virtual sound room of a BRIR. In this case the HRTF part of the PRIR is optimal already since it is that of the listener and does not contain any room reflections or reverberation. What may not be optimal is the reverberation frequency response and time decay characteristics of the PRIR sound room.

Use the BRIR Reverberation Information Directly

Figure 11:
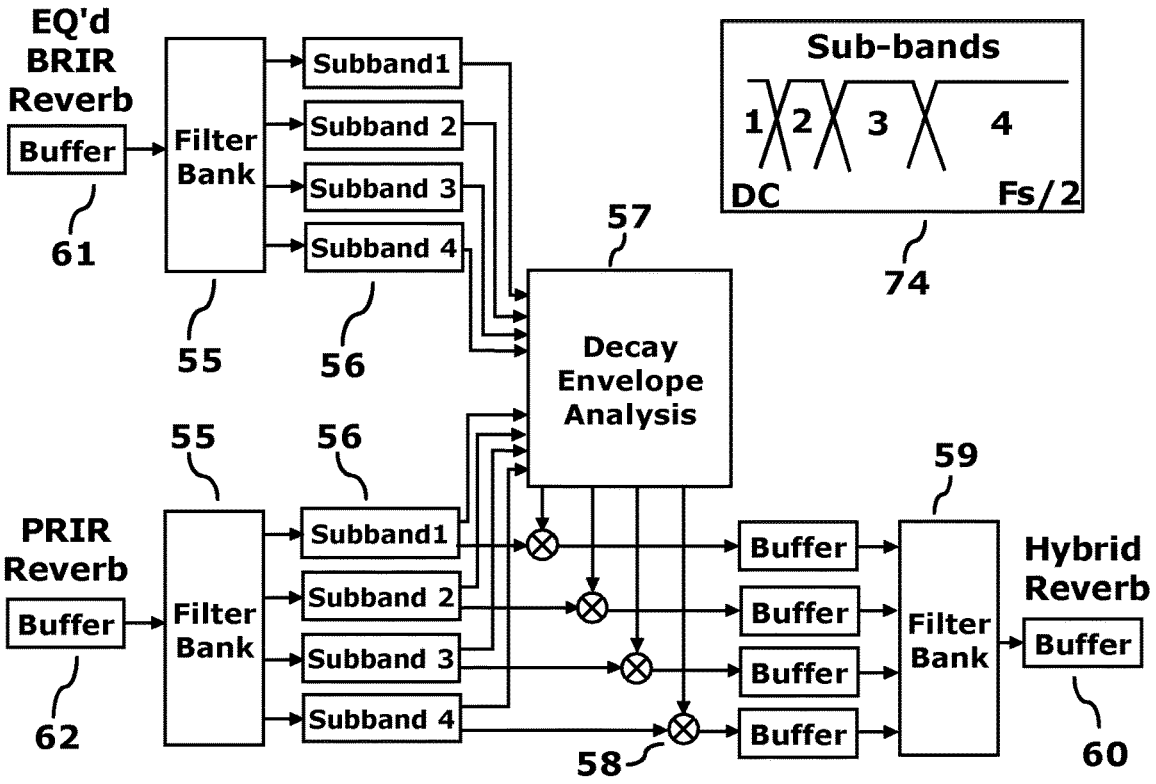
FIG. 11 is a block diagram illustrating a sub-band method or apparatus for directly altering the time and frequency characteristics of the reverberation in a PRIR to conform with that measured in a BRIR to generate hybrid reverberation samples.

FIG. 11 illustrates an example of such a method using a sub-band analysis filter bank. Although four sub-bands 56 are shown in this example and others, the methods described are also valid for more or less frequency divisions and the frequency divisions can be uniform or non-uniform. An example four-band non-uniform division is illustrated 74 for clarity. The reverberation portion of a BRIR loudspeaker is first equalised as described earlier and loaded to the BRIR buffer 61. This equalisation step may not be necessary if the listener is only interested in altering the lower frequency reverberation in the PRIR, i.e. wavelengths which are too long to interact with the outer ear—in which case one would just load the raw BRIR reverberation data. Next the reverberation portion of the same loudspeaker from the PRIR to be modified is loaded to the PRIR buffer 62. The reverberation samples are filtered into separate sub-bands 56 using identical filter banks 55. The sub-band reverberation buffers 56 are then analysed 57 to estimate the reverberation decay profiles for each. Such a profile can be calculated in many ways. One such method is to calculate a moving average of the absolute magnitudes across all the time samples in the buffer, where the averaging window spans a number of adjacent samples. The more samples that span the sliding window, the smoother the envelope. Finally the PRIR reverberation sub-band samples 56 are read out of the buffers and their amplitudes modified 58 on a sample-by-sample basis and stored to a new buffer. The gain factors 58 that modify these samples are also calculated each sample period by dividing the amplitude of the corresponding sub-band BRIR envelope by the amplitude of the sub-band PRIR envelope, for that sample. In this way the PRIR sub-band reverberation decay now matches that of the corresponding BRIR sub-band. The modified PRIR reverberation sub-bands are then recombined 59 into a single full-band reverberation sample set 60. These hybrid reverberation samples are then use to replace those in the original PRIR for that loudspeaker and that ear.

A simplification of FIG. 11 is to generate a reverberation decay profile for each sub-band using just one BRIR loudspeaker, or an average of BRIR loudspeakers, and then to use these same parameters to alter all the reverberation sub-bands of all the PRIR loudspeakers, the assumption being that the reverberation characteristics of a room does not change significantly from loudspeaker position to loudspeaker position.

Use the BRIR Reverberation Information as a Subjective Reference

Figure 12:
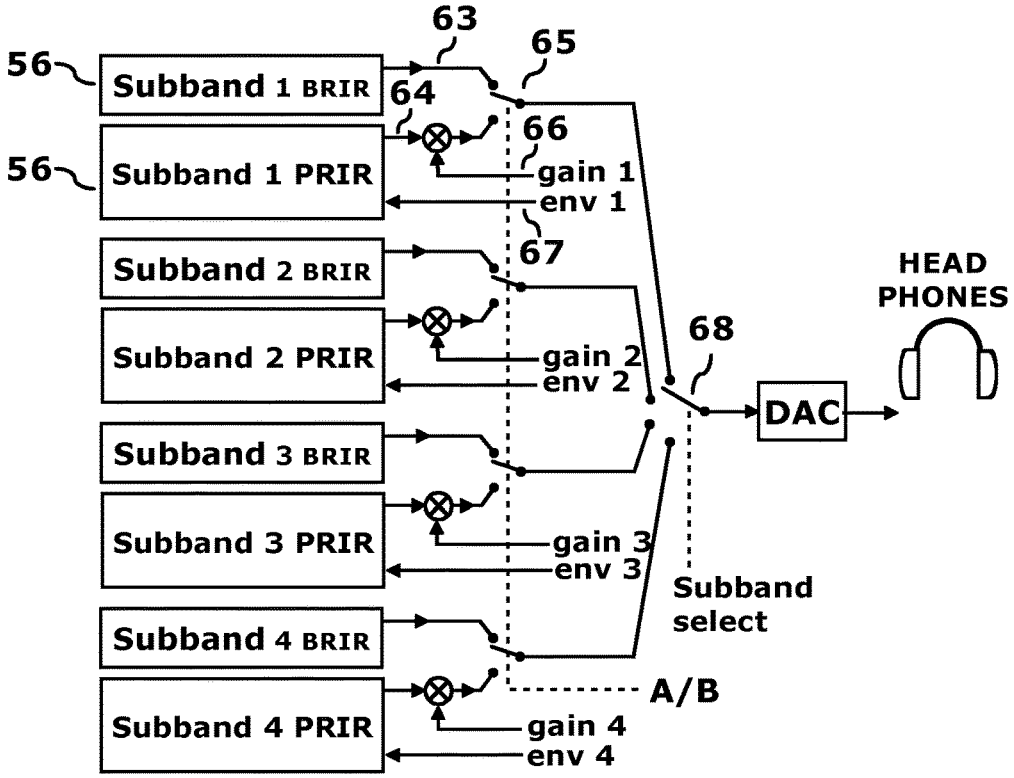
FIG. 12 is a block diagram illustrating a sub-band subjective AB comparison method or apparatus for altering the time and frequency characteristics of the reverberation in a PRIR to conform with that heard in a BRIR.

A subjective method of modifying the PRIR reverberation to match that of the BRIR reverberation is illustrated in FIG. 12 as an alternative to the direct method. In this method the listener alters the gain and reverberation decay profile of the sub-band in real-time through an A-B comparison process while listening over headphones. The sub-band reverberation buffers 56, whose samples are generated as described in FIG. 11, are output to the listener's headphone in a loop, the samples having first been scaled and converted to PCM prior to conversion by the DAC. The headphone listener now hears a repeating reverberation decay sequence of either their own PRIR reverberation 64 or that of the BRIR reverberation 63 via A-B switch 65 for any of the sub-bands via select switch 68. The procedure is to methodically go through each sub-band 68 and adjust the gain 66 and reverberation envelope 67 of the PRIR reverberation sub-band such that peak volume and decay characteristic is similar to that heard in the corresponding BRIR reverberation sub-band.

Figure 15:
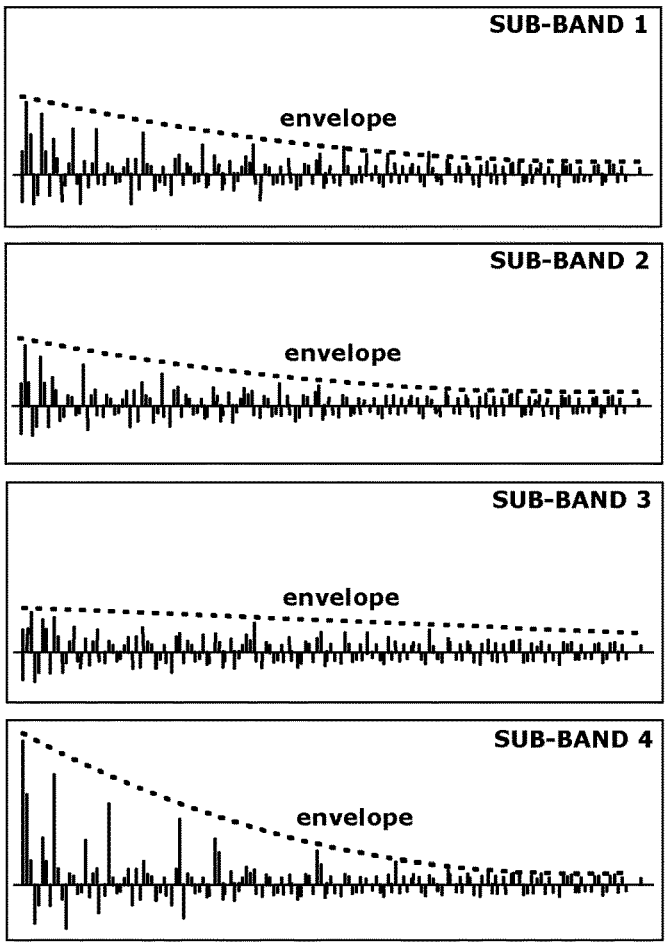
FIG. 15 illustrates exponential decaying amplitude properties of sub-band reverberation signals.
Figure 16:
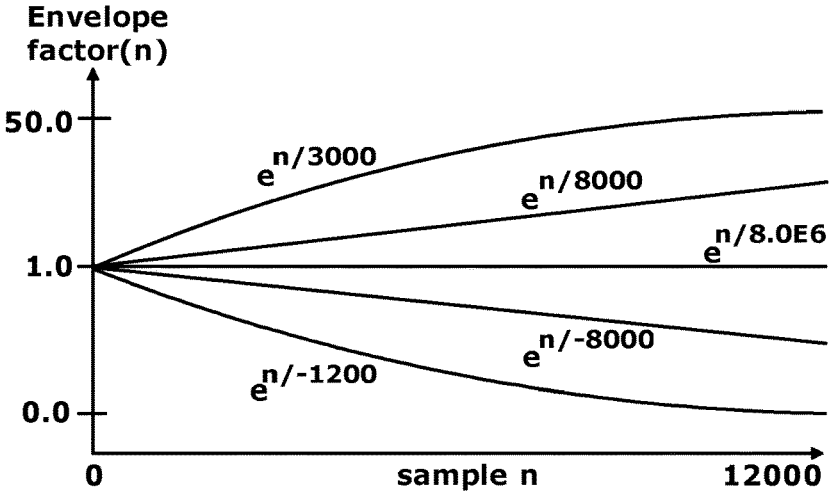
FIG. 16 illustrates an example exponential function for implementing a dynamic envelope control.

The envelope control 67 would typically drive some type of exponential or logarithmic function where the magnitude and sign of the power is altered by the listener. This is because room reverberation exhibits similar decay characteristics. Each time the listener adjusts the envelope control, the amplitude of reverberation samples in the corresponding sub-band PRIR buffer are adjusted to conform to the new exponential curve. FIG. 15 illustrates example reverberation decay envelopes in the four sub-bands where the $4^{th}$ sub-band exhibits a pronounced exponential decay in the samples across the buffer whereas the $3^{rd}$ sub-band exhibits a shallow decay. These are for illustration only but the concept is for PRIR sub-bands to end up with the decay envelopes of the corresponding BRIR sub-bands. There exist many variations on how to dynamically alter the decay envelope but FIG. 16 illustrates an example equation for such a function. The graph shows how the envelope magnitude could vary with changing power over a range, for example, of 12000 buffer samples, where n is the nth sample in the buffer 56, GAIN is the gain value 66 and ENV the envelope control value 67. In the example of FIG. 16 the sub-band buffer holds 12000 reverberation samples. Clearly any exponential or logarithmic function used to implement the method of FIG. 12 will be tailored to the actual buffer length in use.

Once the listener is satisfied with the sub-band matching, the PRIR reverberation sub-band samples are recombined into a full-band reverberation set 59 as shown in FIG. 11, and used to replace the original PRIR reverberation samples. The method of FIG. 12 would typically be repeated for each ear of each loudspeaker the listener wishes to modify. As with FIG. 11 a simplification is to use the energy and reverberation decay profile of just one BRIR loudspeaker, or an average of BRIR loudspeakers, as a comparison against all the different PRIR loudspeakers.

The filter-bank 55 shown in FIGS. 11 and 12 can have any number of bands and be implemented in many different ways. If the number of sub-bands is relatively small, one method is to use band-pass filters that deploy either IIRs or FIRs. The use of band-pass filters simplifies the design of non-uniform sub-bands 74 which are better matched to the human perception of sound. For example, in FIG. 11 or 12 the first sub-band could span DC to 250 Hz, the second 250 to 750 Hz, the third 750 to 1750 Hz and the forth 1750 Hz to Fs/2.

Figure 13:
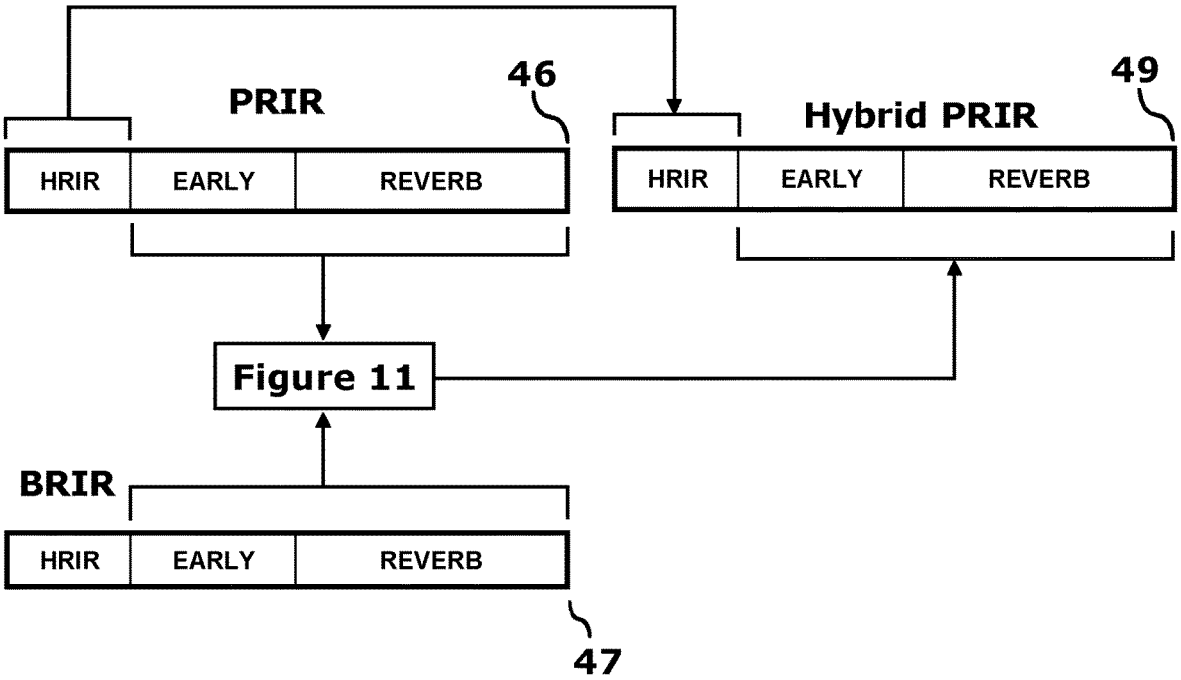
FIG. 13 is a block diagram illustrating steps for generating a hybrid PRIR using information from a BRIR.

For clarification FIG. 13 illustrates an overview of the steps that would be taken to improve the reverberation of a PRIR virtual room using the direct modification method of FIG. 11. In this example both the early reflections and reverberation samples of both PRIR 46 and BRIR 47 are used to calculate the sub-band gain and decay envelopes which are in turn used to modify the early reflection and reverberation samples in the PRIR (46) thus creating the hybrid PRIR 49. The HRIR samples from the PRIR are copied without modification. It should be noted that this feature of the embodiment can operate on just the reverberation samples or it can operate on both early reflection and reverberation samples and this choice would typically be selected by the listener based on their subjective preference.

The method of FIG. 12 is an alternative way of generating the modified PRIR early reflection and reverberation samples of FIG. 13 provided the additional step of converting the PRIR early reflection and reverberation sub-bands back to full-band is undertaken. Again, the method of FIG. 12 can operate with either just reverberation, or both early reflection and reverberation samples as per the listeners preference.

Finally the hybrid BRIRs 49, FIG. 13, are loaded into the listeners virtualiser and used to convolve audio in real-time, thereby recreating the virtual sound room over their headphones.

It will be appreciated by those skilled in the art that there are many ways of analysing and synthesising a signal in time and frequency and that the sub-band filter bank methods of FIGS. 11 and 12 is only one way of achieving this and that other methods for this and the related reverberation decay analysis and conformance can equally be deployed without departing from the spirit of this feature of the invention.

Modifying a PRIR or BRIR for Improved Sound

Another feature of an embodiment of the invention is the facility for allowing the headphone listener to override the reverberation properties of a PRIR, BRIR, equalised BRIR, hybrid PRIR or hybrid BRIR data sets, both in time and frequency, as a means of altering the perceived quality of the virtual sound room. As discussed earlier, often it is the controlled damping of the room reverberation that defines a good sound room, damping that is particularly difficult to control in regular living room environments without major structural changes to the room itself.

Figure 14:
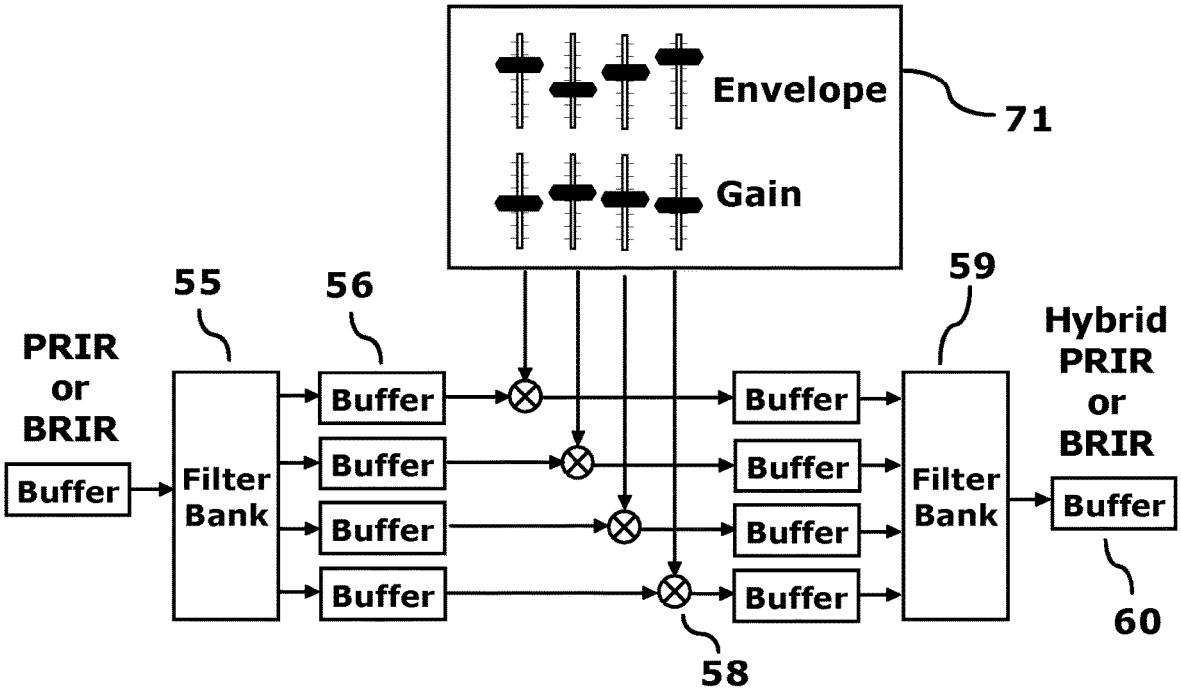
FIG. 14 is a block diagram illustrating a sub-band method or apparatus for adjusting the time and frequency characteristics of a PRIR or BRIR to generate a hybrid version.

A simplification of FIG. 11 illustrated in FIG. 14 removes the ability to modify the sound quality of one room measurement with reference to another room measurement. In this case the listener is altering the reverberation time and frequency characteristics by modifying the sub-band decay and gains manually 71 to their personal taste. One method for allowing the listener to modify sub-band decay is to implement an exponential function whose power is manipulated by 71 as discussed earlier and illustrated in FIGS. 12, 15 and 16. Altering the gain of the sub-bands can also use the method of FIGS. 12 and 16. This method applies equally to PRIRs, BRIRs and the equalised BRIRs and hybrid PRIRs/BRIRs discussed within and would typically be run in conjunction with a real-time virtualiser where every time the listener alters the envelope or gain settings, all the loudspeaker reverberation samples are modified on the fly and loaded back to the virtualiser with minimal interruption. In this way the listener would hear the effect of their adjustments almost instantaneously.

The filter-bank 55 can have any number of bands and be implemented in many different ways. If the number of sub-bands is relatively small, one method is to use band-pass filters deploying either IIRs or FIRs. The use of band-pass filters simplifies the design of non-uniform sub-bands 74 (FIG. 11) which are better matched to human perception of sound. In particular, since reverberation in regular living rooms has the least damping in the lower registers, then this region will be of most interest. For example, in FIG. 14 the first sub-band could span DC to 250 Hz, the second 250 to 750 Hz, the third 750 to 1750 Hz and the forth 1750 Hz to half the sampling frequency (Fs/2).

The steps of FIG. 14 can also be used to operate on the entire impulse response, including the HRIR, or it can be restricted to adjusting just the early reflection samples and reverberation samples, or just the reverberation samples on their own. Moreover it will be appreciated that the envelope and gain controls 71 could operate on both ear signals together or separate controls could be provided for each ear signal.

It will be appreciated by those skilled in the art that there are many ways of analysing and synthesising a signal in time and frequency and that the sub-band filter bank methods of FIGS. 11, 12 and 14 is only one way of achieving this and that other methods for this and the related reverberation decay modification can equally be deployed without departing from the spirit of this aspect of the invention.

Embodiments of any aspect of the present invention may be implemented by a suitably configured digital signal processing (DSP) apparatus. The DSP apparatus may comprise hardware, firmware and/or software as is convenient. The subject matter of FIGS. 5 to 12 and 14 are described herein in terms of processing methods but may equally represent architectures for performing the respective processing steps. The methods disclosed herein may be referred to as digital signal processing.

Aspects of the invention may be embodied in an audio system for virtualisation of a set of loudspeakers by headphones (where "headphones" is intended to embrace "ear phones"), wherein the system includes an audio virtualiser configured to transform audio loudspeaker signals into virtualised loudspeaker signals for playback over headphones, rendered using a set of binaural room impulse responses. Advantageously the binaural room impulse responses are of the modified described herein or otherwise embodying any of the various aspects of the present invention.

Aspects of the invention may be embodied as an audio virtualiser configured to transform audio loudspeaker signals into virtualised loudspeaker signals for playback over headphones, rendered using a set of binaural room impulse responses. Advantageously the binaural room impulse responses are of the modified described herein or otherwise embodying any of the various aspects of the present invention. The audio virtualiser transforms audio loudspeaker signals in real time, the transformed, or virtualised, signals being rendered by the headphones to the listener in real time.

It will be apparent that preferred embodiments of the invention manipulate digital room impulse responses in a way that allows the listener to better experience virtual sound rooms that they do not have the opportunity to visit in person.

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above teachings.

The invention claimed is:

1. A digital signal processing method for creating binaural room impulse response data, the method comprising:

providing data representing a personalized binaural room impulse response, said personalized binaural impulse response being created with respect of a target listener;

providing data representing a non-personalized binaural room impulse response, said non-personalized binaural impulse response being created with respect of a dummy or a person other than the target listener; and using said personalized binaural impulse response data and said non-personalized binaural impulse response data to create data representing a hybrid binaural room impulse response;

wherein creating said hybrid binaural room impulse response data involves modifying said non-personalized binaural room impulse response with at least one aspect of said personalized binaural room impulse response that is independent of a room in which said personalized binaural room impulse response is created, and using said modified non-personalized binaural room impulse response as said hybrid binaural room impulse response.

2. The method of claim 1, wherein said data comprises a plurality of portions, each portion representing a different aspect of said respective binaural room impulse response;

the creating of said hybrid binaural room impulse response data involves:

using at least one portion of said personalized binaural room impulse response data to provide the or each corresponding portion of said hybrid binaural room impulse response data; and using at least one other portion of said non-personalized binaural room impulse response data to provide the or each other corresponding portion of said hybrid binaural room impulse response data;

said plurality of portions comprising a first portion representing a portion of the respective binaural room impulse response that is independent of a room which said respective binaural room impulse response represents;

creating said hybrid binaural room impulse response data involving using the first portion of said personalized binaural room impulse response data to provide the first portion of said hybrid binaural room impulse response data; and said first portion comprising data representing a head related impulse response (HRIR) portion of the respective binaural room impulse response, said HRIR portion of said personalized binaural room impulse response data being used to provide the HRIR portion of said binaural room impulse response data, the HRIR data portion comprising data representing at least one frequency component of the HRIR portion of the personalized binaural room impulse response.

3. The method of claim 2, further comprising filtering said HRIR data portion of said personalized binaural room impulse response, and using said filtered HRIR data portion to provide the HRIR portion of said hybrid binaural room impulse response data, the filtering including high pass filtering or band pass filtering.

4. The method of claim 2, further comprising:

overwriting said first portion of said non-personalized binaural room impulse response data with the first portion of said personalized binaural room impulse response data to create said hybrid binaural room impulse response data; and filtering the respective first portion of each of said personalized and non-personalized binary room impulse response data prior to said overwriting, the filtering including high pass filtering or band pass filtering.

5. The method of claim 2, wherein said plurality of portions comprise at least one room-dependent portion that is dependent on a room which the respective binaural room impulse response represents;

said personalized binaural room impulse response is created in a first room;

said non-personalized binaural room impulse response is created in a second room having better acoustic characteristics than said first room;

at least one one room-dependent portion of said non-personalized binaural room impulse response data is used to provide the or each corresponding room-dependent portion of said hybrid binaural room impulse response data; and the creating of said hybrid binaural room impulse data involves using said at least one one room-dependent portion of said non-personalized binaural room impulse response data to modify the or each corresponding room-dependent portion of said personalized binaural room impulse response data.

6. The method of claim 5, wherein data representing at least one selected from the group consisting of a reflections portion and a reverberation portion of the non-personalized binaural room impulse response is used to provide the or each corresponding portion of the hybrid binaural room impulse response data.

7. The method of claim 5, wherein said at least one room-dependent portion comprises data representing at least one characteristic of a reverberation portion of said non-personalized binaural room impulse response; and the creating of said hybrid binaural room impulse response data involves using said data representing at least one reverberation characteristic of said non-personalized binaural room impulse response to provide data representing the or each corresponding characteristic of a reverberation portion of said hybrid binaural room impulse response.

8. The method of claim 7, wherein said at least one characteristic is at least one selected from a group consisting of a time decay profile and a gain.

9. The method of claim 7, wherein said at least one characteristic comprises at least one time characteristic including a time decay characteristic and at least one frequency characteristic including a frequency response characteristic.

10. The method of claim 5, wherein said at least one room-dependent portion comprises data representing at least one characteristic of a reflection portion of said non-personalized binaural room impulse response; and the creating of said hybrid binaural room impulse response data involves using said data representing at least one reflection characteristic of said non-personalized binaural room impulse response to provide data representing the or each corresponding characteristic of a reflection portion of said hybrid binaural room impulse response.

11. The method of claim 5, wherein providing the or each corresponding room-dependent portion of said hybrid binaural room impulse response data involves performing digital signal analysis of the respective room-dependent portion of the non-personalized binaural room impulse response data and the personalized binaural room impulse response data using sub-band analysis filter banks.

12. The method of claim 5, wherein providing the or each corresponding room-dependent portion of said hybrid binaural room impulse response data involves performing a comparative listening test.

13. The method of claim 1, wherein the respective binaural room impulse response data comprises data representing an inter-aural time delay, the inter-aural time delay data of said personalized binaural room impulse response is used to provide the inter-aural time delay data of said hybrid binaural room impulse response data.

14. The method of claim 1, wherein the respective binaural room impulse response data includes at least one portion representing a portion of the respective binaural room impulse response that is dependent on a room that the respective binaural room impulse response represents;

the creating of said hybrid room impulse response data involves modifying at least one room-dependent portion of said non-personalized binaural room impulse response data using an omni-directional head transfer function (HRTF) of said personalized binaural room impulse response data and an omni-directional head transfer function (HRTF) of said non-personalized binaural room impulse response data, and using said at least one modified room dependent portion in said hybrid binaural room impulse response data;

said modifying involves filtering said at least one room-dependent portion of said non-personalized binaural room impulse data using a filter representing the difference between said omni-directional head transfer functions; and said filtering comprises equalization filtering and said filter comprises an equalization filter.

15. The method of claim 14, wherein the difference between said omni-directional head transfer functions is determined by digital signal analysis of said omni-directional head transfer functions.

16. The method of claim 14, wherein the difference between said omni-directional head transfer functions is determined by performing a comparative listening test, said comparative listening test involving comparing, by listening to, a test audio signal processed by the first portion of said non-personalized binaural room impulse data and the test audio signal processed by the first portion of said personalized binaural room impulse data, and adjusting, by adjustably filtering, said test audio signal processed by the first portion of said non-personalized binaural room impulse data to match the test audio signal processed by the first portion of said personalized binaural room impulse data.

17. The method of claim 14, wherein said at least one room dependent portion comprises data representing a reflections portion and a reverberation portion of the respective binaural room impulse response, said data representing at least one of said reflections portion and said reverberation portion is modified using said omni-directional head transfer functions.

18. The method of claim 1, wherein creating said hybrid binaural room impulse response data involves modifying said personalized binaural room impulse response with at least one aspect of said non-personalized binaural room impulse response that is dependent on a room in which said non-personalized binaural room impulse response is created, and using said modified personalized binaural room impulse response as said hybrid binaural room impulse response; and said at least one room-dependent portion comprises data representing at least one reverberation characteristic of said non-personalized binaural room impulse response.

19. The method of claim 1, further comprising creating a hybrid binaural room impulse data set comprising respective hybrid binaural room impulse data for each of a plurality of loudspeaker-to-head orientations.

20. The method of claim 1, further comprising:

transforming an audio signal into a virtualized audio signal using said binaural room impulse response data; and rendering said virtualized audio signal to a listener.

21. A digital signal processing method for modifying data representing a binaural room impulse response, said data including data representing at least one selected from a group consisting of a reflections portion and a reverberation portion of said binaural room impulse response, said method comprising:

modifying said data to modify at least one characteristic of said at least one selected from the group consisting of said reflections portion and of said reverberation portion;

said at least one characteristic including a frequency response characteristic or time decay characteristics and being modified to conform to the or each corresponding characteristic of the respective portion of a reference binaural room impulse response, the reference binaural room impulse response being a personalized or non-personalized binaural room impulse response or a hybrid binaural room impulse response; and said modification to conform involves performing digital signal analysis of data representing said binaural room impulse response and data representing said reference binaural room impulse response.

22. The method of claim 21, wherein said modification to conform is performed by performing a comparative listening test between an audio signal rendered using said binaural room impulse response data and using said reference binaural room impulse response data.

23. The method of claim 21, wherein said modifying is performed empirically according to a listener's preference.

24. The method of claim 21, including performing sub-band analysis of all or part of said binaural room impulse response data; and said modifying involves modifying said at least one characteristic of at least one of the resulting sub-band data, and synthesizing the sub-band data, including any modified sub-band data.

25. The method of claim 21, wherein said at least one characteristic comprises at least one selected from a group consisting of a gain and decay envelope characteristic.

26. The method of claim 21, wherein said modifying is performed in real-time during audio virtualization of an audio signal using said binaural room impulse response data.

27. A digital signal processing apparatus for creating binaural room impulse response data, said apparatus comprising digital signal processing means for:

providing data representing a personalized binaural room impulse response, said personalized binaural impulse response being created in respect of a target listener;

providing data representing a non-personalized binaural room impulse response, said non-personalized binaural impulse response being created in respect of a dummy or a person other than the target listener;

using said personalized binaural impulse response data and said non-personalized binaural impulse response data to create data representing a hybrid binaural room impulse response; and creating said hybrid binaural room impulse response data by modifying said non-personalized binaural room impulse response with at least one aspect of said personalized binaural room impulse response that is independent of a room in which said personalized binaural room impulse response is created, and using said modified non-personalized binaural room impulse response as said hybrid binaural room impulse response.

28. A system comprising the digital signal processing apparatus of claim 27, wherein the digital signal processing means is further for transforming an audio signal into a virtualized audio signal using said binaural room impulse response data; and the system further including headphones for rendering said virtualized audio signal to a listener.

* * * * *